US005570117A

United States Patent [19]

Karambelas et al.

[11] Patent Number: 5,570,117

[45] Date of Patent: Oct. 29, 1996

[54] PRINT HEAD MAINTENANCE METHOD AND APPARATUS WITH RETRACTABLE WIPER

[75] Inventors: Randy C. Karambelas, Milwaukie; Ernest I. Esplin, Sheridan; Terry A. Smith; Mike C. Gordon, both of Wilsonville; Stephen H. Skidmore, Portland, all of Oreg.

[73] Assignee: Tektronix, Inc., Wilsonville, Oreg.

[21] Appl. No.: 369,613

[22] Filed: Jan. 6, 1995

[51] Int. Cl.[6] ..... B41J 2/165

[52] U.S. Cl. ..... 347/33; 347/32

[58] Field of Search ..... 347/29, 30, 32, 347/33, 103, 88, 92, 93

[56] References Cited

U.S. PATENT DOCUMENTS

| | | | |
|---|---|---|---|
| 4,015,272 | 3/1977 | Yamamori et al. | 347/68 |
| 4,543,591 | 9/1985 | Terasawa | 347/30 |
| 4,600,931 | 7/1986 | Terasawa | 347/30 |
| 4,800,403 | 1/1989 | Accattino et al. | 347/30 |
| 4,951,066 | 8/1990 | Terasawa et al. | 347/33 |
| 4,959,673 | 9/1990 | Noda | 347/33 |
| 4,970,535 | 11/1990 | Oswald et al. | 347/25 |
| 5,184,147 | 2/1993 | MacLane et al. | 347/30 |

FOREIGN PATENT DOCUMENTS

| | | | |
|---|---|---|---|
| 62-111751 | 5/1987 | Japan | 347/33 |

*Primary Examiner*—John E. Barlow, Jr.
*Attorney, Agent, or Firm*—Ralph D'Alessandro; Paul S. Angello

[57] ABSTRACT

A method and an apparatus (10) for cleaning an ink jet print head (12) draws contaminates from orifices (20) in the print head onto an orifice plate (14) and then wipes the orifice plate. The maintenance apparatus includes a purge cap (24) that has a recessed region (40) with an open end (36). The top side margins (42) of the open end define a periphery (44) around which a seal (60) is positioned. A positioning system (30) urges the orifice plate against the seal. A heating system (128) and a vacuum system (74) cooperate to create a differential pressure across the orifices to draw contaminates carried by liquid ink out of them and onto the orifice plate. A resilient wiper assembly (26) including a spring-mounted wiper blade (78) is positioned in and nominally extends outwardly of the recessed region of the purge cap. The positioning system moves the purge cap downwardly against the orifice plate so that the wiper blade engages and wipes the contamination from the orifice plate.

13 Claims, 10 Drawing Sheets

118
82
84
94
78
80
98
96
76
100
104
114
112
88
86
116
92
90
106
102

PRINT HEAD MAINTENANCE METHOD AND APPARATUS WITH RETRACTABLE WIPER

TECHNICAL FIELD

The present invention relates to a print head maintenance method and apparatus with a retractable wiper for cleaning ink and debris from the orifices and orifice plate of an ink jet print head.

BACKGROUND OF THE INVENTION

Certain types of printers typically create a printed image by ejecting ink through orifices contained in an orifice plate onto an image receiving medium such as a print medium or a drum that transfers the image to the print medium. Repeated printing builds up contaminates, such as unused ink and debris from the print medium, in the orifices and on the orifice plate. To ensure a high quality printed image, the print head must be periodically cleaned of this contamination to provide an unhindered ink trajectory from the orifices.

A typical conventional cleaning sequence entails drawing ink and debris from the orifices onto the orifice plate and then wiping the orifice plate. One currently available printer, such as the printer shown in U.S. Pat. No. 5,184,147 to MacLane et at., includes a purge cap for drawing contamination from the orifices and a wiper mounted to the exterior of the purge cap for wiping the contamination from the orifice plate.

The purge cap and exterior wiper design of MacLane has several disadvantages: the purge cap and the exterior wiper each occupy a separate volume of space in the printer so that the printer design is not compact; time is required to move the orifice plate from the purge cap to the wiper so that the cleaning operation is slow; the purge cap cannot maintain a vacuum pressure on the orifice plate so that ink is not drawn from the orifices were the wiper to be used to wipe the orifice plate while under the vacuum; the wiper cannot be washed with clean ink ejected from the orifices because the purge cap will not catch the ink and so the utility of the cleaning operation is diminished unless the wiper is periodically manually cleaned; and the exteriorly mounted wiper is exposed to debris accumulating within the printer because the purge cap does not shield the wiper.

Accordingly, a need exists for a print head maintenance method and apparatus that clean a print head without the disadvantages of the prior art.

SUMMARY OF THE INVENTION

An object of the present invention is, therefore, to provide an apparatus and a method in which the purge cap and the wiper occupy substantially the same volume of space in the printer so that the printer is compact.

Another object of the invention is to provide such an apparatus and a method that requires little or no time to move the orifice plate from the purge cap to the wiper so that the cleaning operation can be carried out quickly.

A further object of the invention is to provide such an apparatus and a method that maintain vacuum pressure on the orifices so that ink is drawn from the orifices followed by the wiper mechanism wiping the orifice plate.

Still another object of the invention is to provide such an apparatus and a method in which the wiper is washed with ink from the orifices and in which the purge cap catches the ink so that the wiper is periodically automatically washed.

Yet another object of the invention is to provide such an apparatus and a method in which the purge cap shields the wiper from the accumulation of debris within the printer.

The present invention is a method and an apparatus for cleaning an ink jet print head by drawing contaminates from orifices placed in a region of an orifice plate and then wiping the contaminants from the region. The maintenance apparatus includes a purge cap that has an open end and a recessed region defined by a rear wall bordered by side walls. The side walls have top side margins that define the periphery of the open end. The length of the purge cap spans the region of the orifice plate that contains the ink jet orifices. A seal positioned around the periphery of the purge cap provides a vacuum seal between the purge cap and the region of the orifice plate containing the orifices when a positioning system urges the orifice plate against the purge cap.

When the positioning system urges the orifice plate against the purge cap seal, a heater connected to the purge cap heats ink solidified in the orifices. A support structure mounting the purge cap to the positioning system includes a biasing mechanism that provides even alignment and engagement between the purge cap and the orifice plate. A vacuum system connected to the purge cap creates a pressure differential across the orifices to draw the molten ink and debris out of the orifices, onto the orifice plate and into the purge cap.

A resilient wiper assembly positioned in the recessed region of the purge cap includes a wiper blade that extends along the length of the purge cap and nominally outwardly of the recessed region. While the positioning system urges the orifice plate against the purge cap seal, the orifice plate forces the wiper to retract from its nominal position and rearwardly into the recessed region while still contacting the orifice plate. The positioning system then moves the purge cap downwardly and against the orifice plate so that the wiper blade wipes the contamination from the region of orifice plate containing the orifices.

Additional objects, features and advantages of the present invention will be apparent from the following detailed description of the preferred embodiments when taken in conjunction with the accompanying drawings.

DETAILED DESCRIPTION OF PREFERRED EMBODIMENTS

Figure 1:
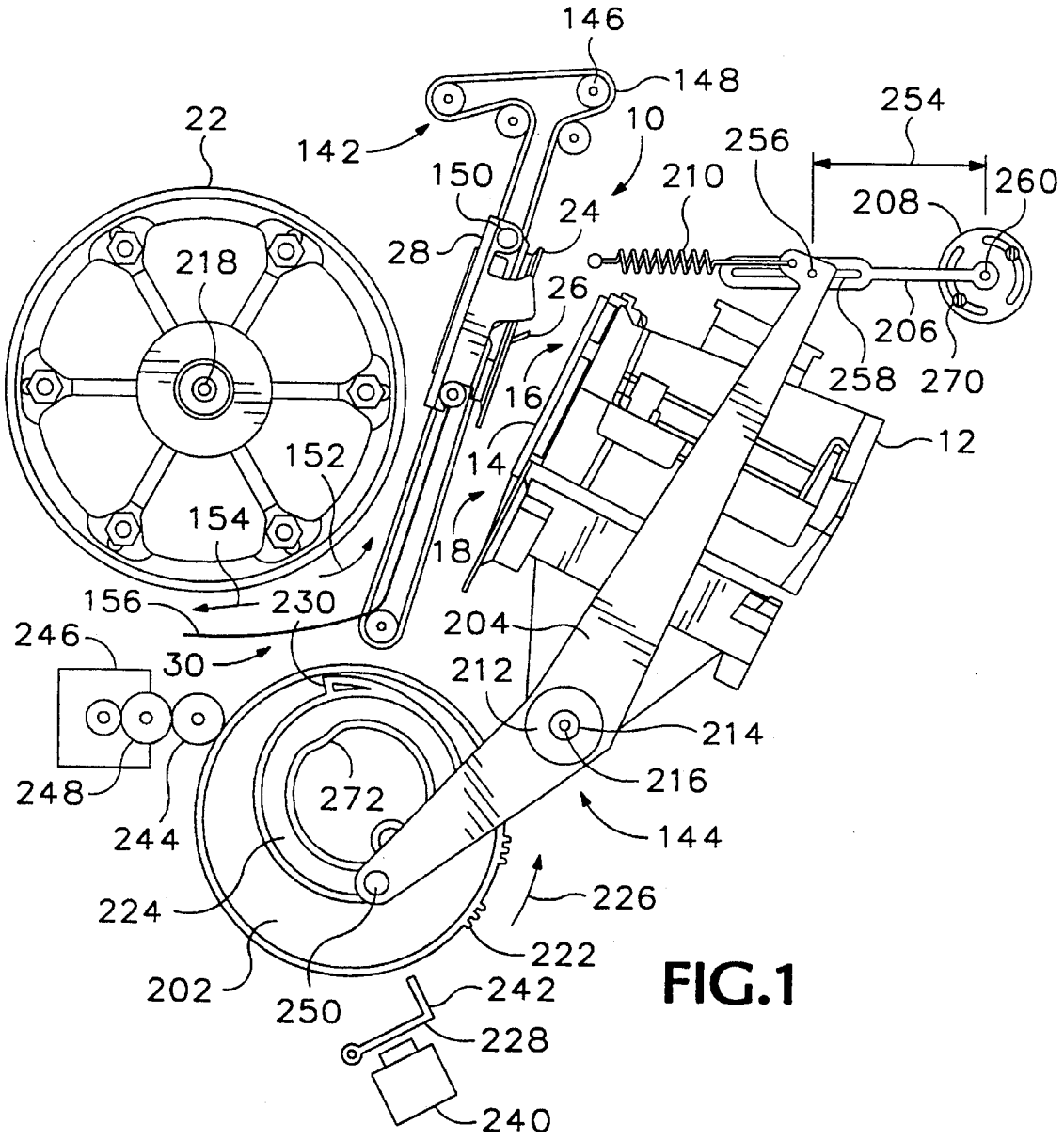
FIG. 1 is an end elevational view of the purge cap, positioning system, print head, and drum, showing the purge cap and the print head in a standby position.
Figure 2:
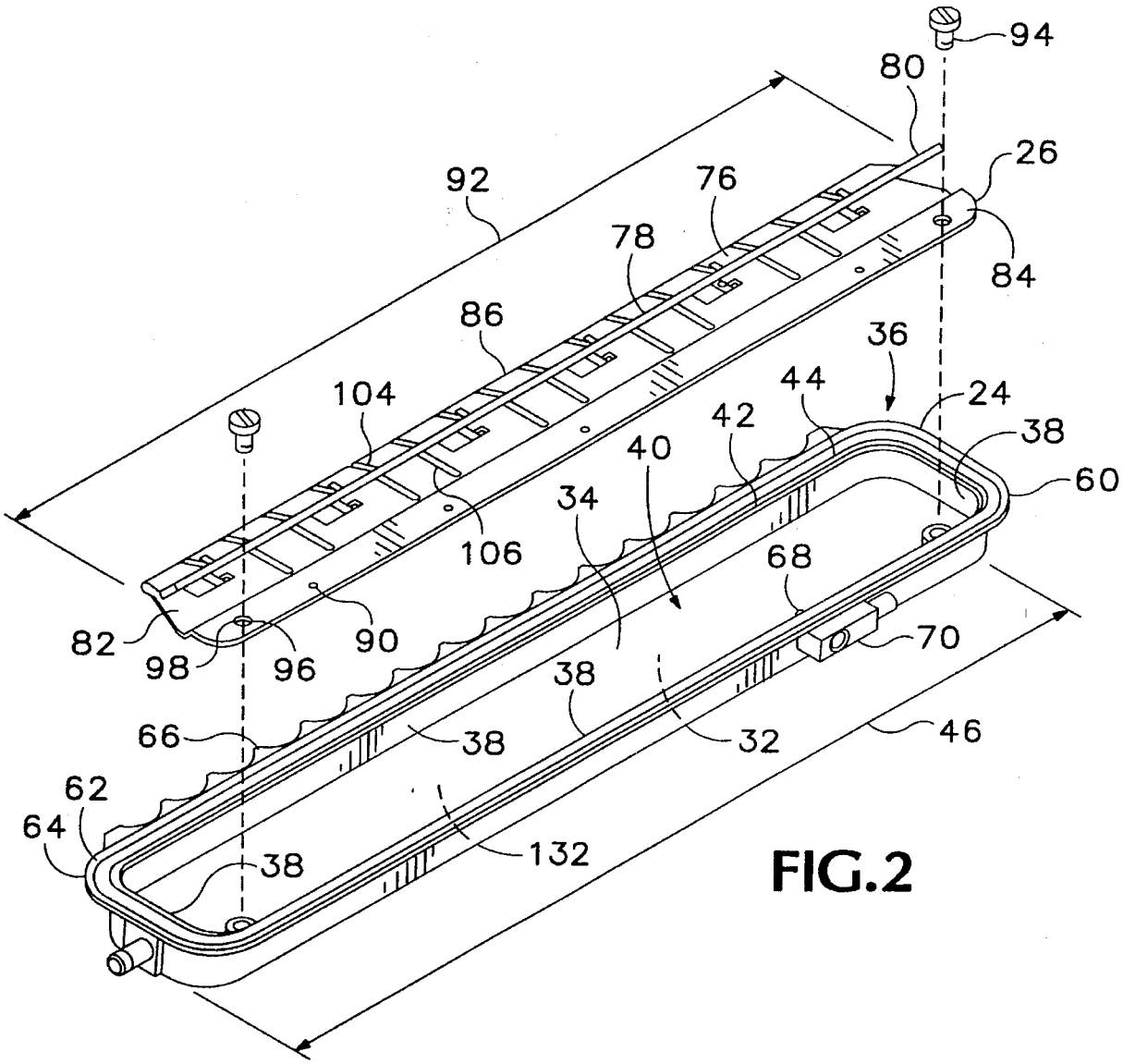
FIG. 2 is an exploded isometric frontal view of the purge cap and wiper assembly.
Figure 7:
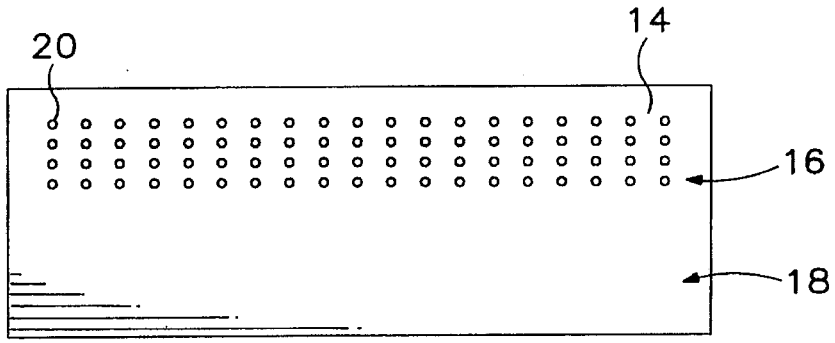
FIG. 7 is a front plan view of the orifice plate and the orifices.

FIG. 1 shows a maintenance apparatus 10 designed for installation in an ink jet printer (not shown). The printer includes a print head 12 having an orifice plate 14 (shown more clearly in FIG. 7) with first and second adjacent regions 16 and 18, the first region 16 containing multiple rows of multiple orifices 20. Print head 12 ejects ink from orifices 20 to create an image on an intermediate liquid transfer surface (not shown), such as silicone oil, that is supported by drum 22, which then transfers the image to a print medium (not shown) such as a sheet of paper.

Maintenance apparatus 10 includes a purge cap 24 that holds a resilient wiper assembly 26 for periodically cleaning orifice plate 14 of print head 12. Maintenance apparatus 10 also includes a support system 28 that attaches purge cap 24 to a positioning system 30. Positioning system 30 positions print head 12 adjacent purge cap 24 containing wiper assembly 26 and moves purge cap 24 downwardly so that wiper assembly 26 wipes orifice plate 14 from region 16 to region 18.

FIGS. 2–5 more clearly show purge cap 24 and wiper assembly 26. Purge cap 24 has a closed bottom end 32 with a rear wall 34 located opposite an open top end 36 and joined to side walls 38 to form a recessed interior region 40. The upper side margins 42 of side walls 38 define a periphery 44 at open top end 36. Purge cap 24 has a length 46 that spans the length of region 16 to enable complete wiping coverage of orifices 20 in orifice plate 14, as will be described below. A preferred purge cap 24 is molded of die cast aluminum, is 23 centimeters (9 inches) in length measured along length 46, and is 1.3 centimeters (0.5 inch) deep from open top end 36 to closed bottom end 32 measured along side walls 38.

A seal 60 positioned around periphery 44 of purge cap 24 has an outer edge 62 with a flexible, resilient raised region 64 for contacting orifice plate 14. Seal 60 also has serrations 66 that direct ink to drip off seal 60 into an ink reservoir (not shown) when seal 60 is not engaged with orifice plate 14.

Seal 60 is preferably manufactured of flexible silicone rubber to ensure a substantially air tight, even engagement between it and orifice plate 14. Seal 60 can be manufactured directly as part of purge cap 24 or can be formed separately and then fitted on and secured with adhesive to purge cap 24.

Purge cap 24 includes a vacuum system inlet 68 that communicates with a vacuum port 70 and recessed region 40 of purge cap 24. Vacuum port 70 is connected by tubing 72 (FIG. 3) to a vacuum system 74 that creams a differential pressure across orifices 20 in orifice plate 14 when seal 60 is engaged with orifice plate 14. The differential pressure causes expulsion of ink and debris from orifices 20 onto orifice plate 14.

Vacuum system 74 preferably includes a spherical chamber(not shown) having a volume of 557 cubic centimeters (34 cubic inches) that creates a $6.8\times10^4$ Pascals (9.8 pounds per square inch) vacuum at sea level. The spherical chamber is mechanically evacuated to create the differential pressure across orifices 20.

Figures 6A, 6B, 6C:
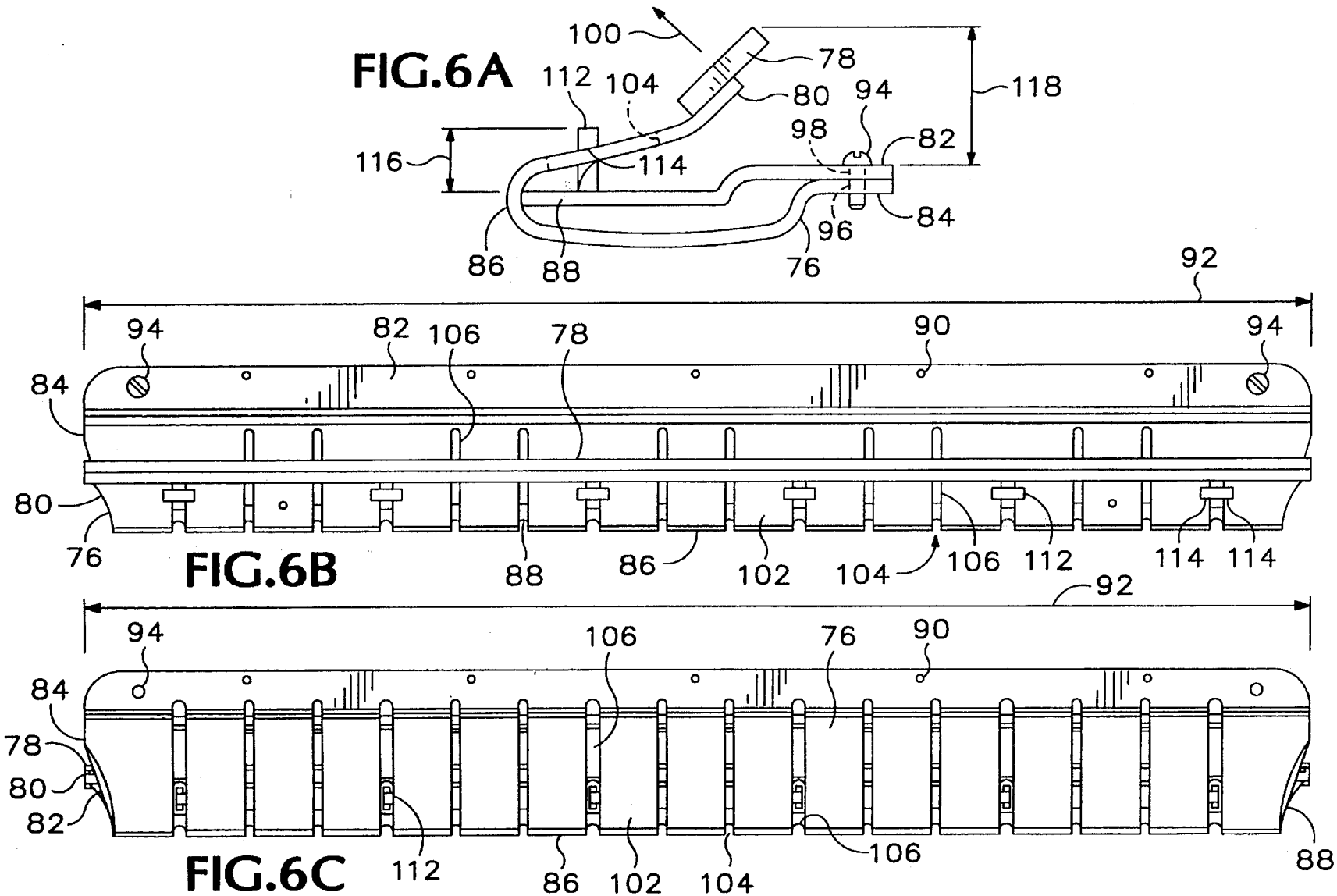
FIGS. 6A, 6B, and 6C are, respectively, an end view, a front plan view, and a rear plan view of the wiper assembly.

FIGS. 6A, 6B, and 6C show different views of resilient wiper assembly 26, which includes a wiper spring 76 carrying a wiper blade 78 at a first end 80 and secured to a stiffener 82 at a second end 84. Wiper spring 76 is folded back upon itself between its ends 80 and 84 at a medial point 86 located at a free end 88 of stiffener 82 to form an acute angle of about 30 degrees between wiper blade 78 and stiffener 82. Wiper spring 76 and stiffener 82 are joined by spot welds 90 positioned at second end 84 along length 92 of wiper spring 76. Resilient wiper assembly 26 is installed in interior region 40 of purge cap 24 by screws 94 positioned through axially aligned holes 96 and 98 in, respectively, wiper spring 76 and stiffener 82 at second end 84 along length 92.

In a preferred implementation., wiper spring 76 and stiffener 82 are manufactured of stainless steel. Wiper spring 76 is about 0.01 centimeters (0.004 inches) in thickness and is flexible along its length. Stiffener 82 is about 0.09 centimeters (0.025 inches) in thickness and is generally rigid. Wiper blade 78 is about 0.13 centimeters (0.05 inches) in thickness and is manufactured of flexible fluorinated silicone rubber molded directly on first end 80 of wiper spring 76.

Wiper spring 76 is folded back upon itself at point 86 and is supported there by stiffener 82 to impart a resiliency to wiper spring 76 and create a spring force that nominally extends first end 80 in a direction 100 outwardly from recessed region 40 and second end 84. The resilient force of wiper spring 76 is preferably of a magnitude sufficient to force wiper blade 78 into engagement with orifice plate 14 but insufficient to damage a Teflon® coating placed on orifice plate 14.

Wiper spring 76 includes spaced apart along its length multiple spring elements 102 that collectively provide along the length of wiper blade 78 a substantially uniform engagement pressure between wiper blade 78 and orifice plate 14. The spaces between adjacent multiple spring elements 102 form slots 104 that are aligned with elongated slits 106 in stiffener 82 to allow ink drawn from orifices 20 by vacuum system 74 to flow through resilient wiper assembly 26 and toward vacuum system inlet 68.

Stiffener 82 includes twist ties 112 each having shoulders 114 that extend outwardly through slots 104 and are turned relative to the length of slots 104 so that shoulders 114 contact adjacent spring elements 102 of wiper spring 76. Ties 112 have a predetermined length 116 and thereby restrain wiper blade 78 from moving beyond a distance 118 from second end 84 of wiper spring 76. Shoulders 114 do not, however, inhibit wiper blade 78 from retracting toward second end 84 and into recessed region 40.

Figure 8:
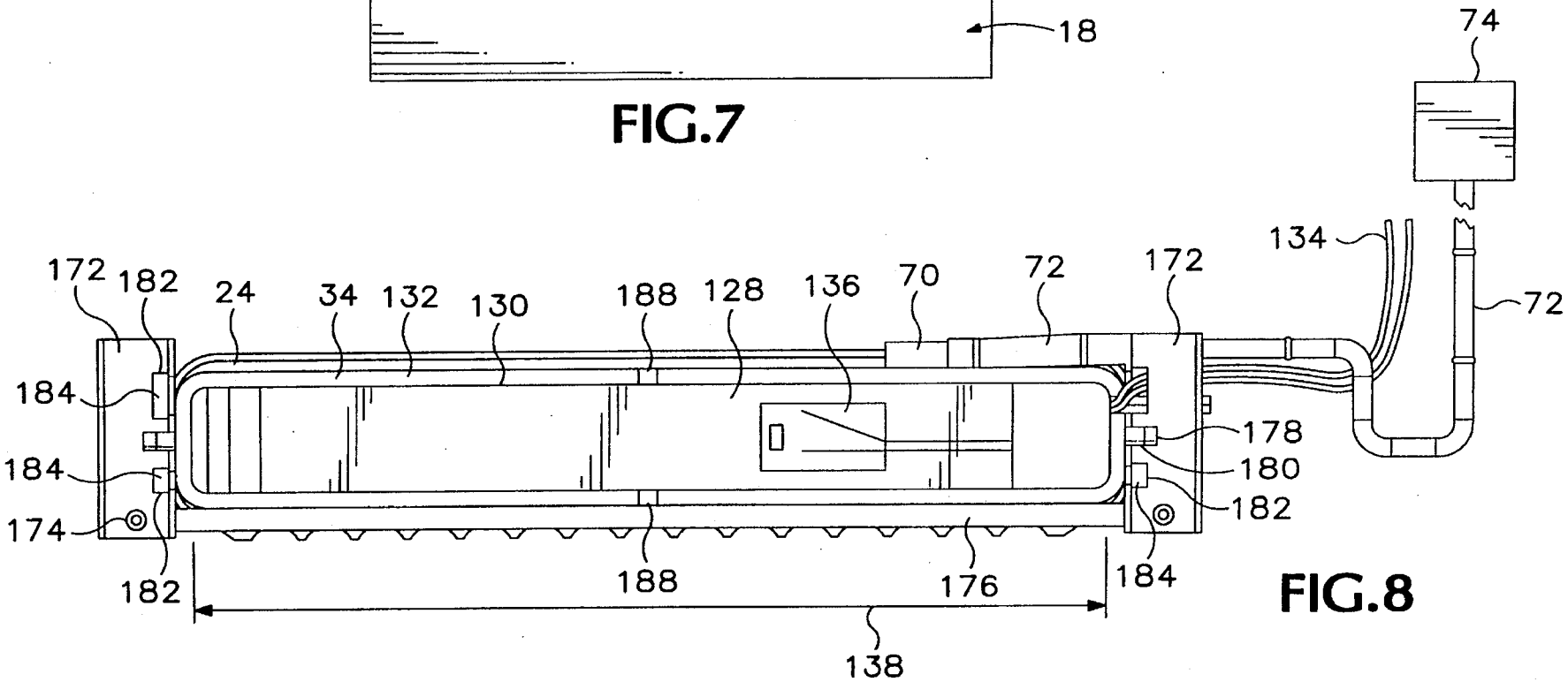
FIG. 8 is a rear plan view of the purge cap of FIG. 5 with the cap spring removed to show the heater.

FIG. 8 shows a heating system or heater 128 fitted inside and thermally coupled to a recessed region 130 of an exterior side 132 of rear wall 34 of purge cap 24. Heater 128 includes wires 134 connected to a power source (not shown) and connected to heat elements 136 positioned along the length 138 of the heater 128. Heater 128 typically reaches a temperature of 140 degrees Celsius (284 degrees Fahrenheit).

When purge cap 24 is engaged with orifice plate 14, heater 128 heats purge cap 24 and the air contained inside recessed region 40 of purge cap 24 to melt any ink solidified inside orifices 20. Vacuum system 74 creates a pressure differential across orifices 20 and draws the molten ink from them onto orifice plate 14, and then wiper assembly 26 wipes the molten ink away from orifices 20.

Figure 10:
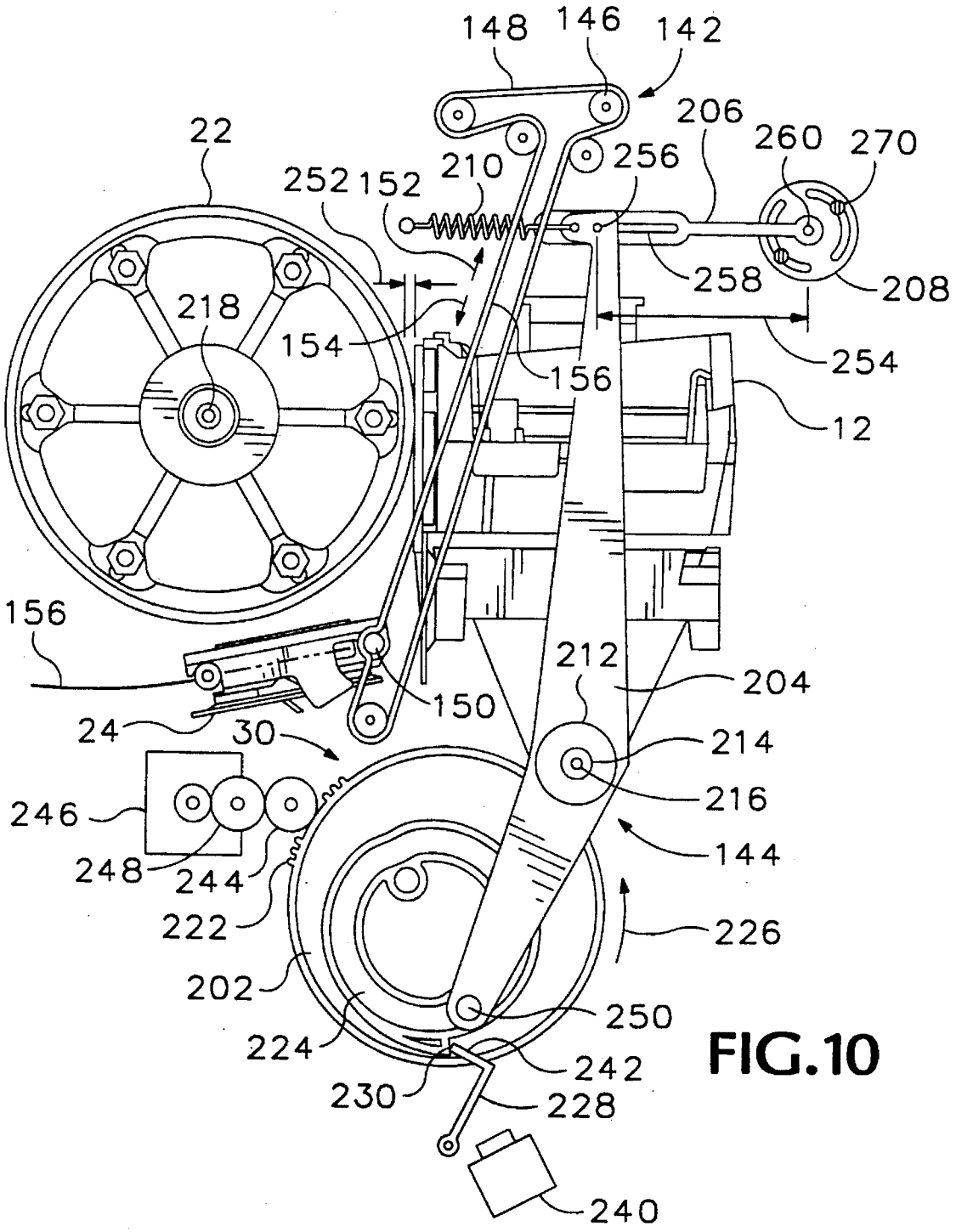
FIG. 10 is an end elevational view of the purge cap, positioning system, print head, and drum of the printer, showing the purge cap stowed below the drum and the print head in the printing position.

FIGS. 1 and 10 show a preferred embodiment of positioning system 30 that positions print head 12 and purge cap 24. Positioning system 30 includes a belt and pulley system 142 that applies a force to position purge cap 24 adjacent print head 12 or below drum 22. Positioning system 30 also includes a print head tilt angle system 144 that applies a force to urge print head 12 adjacent drum 22 (FIG. 10) and purge cap 24 (FIG. 1).

Figure 9:
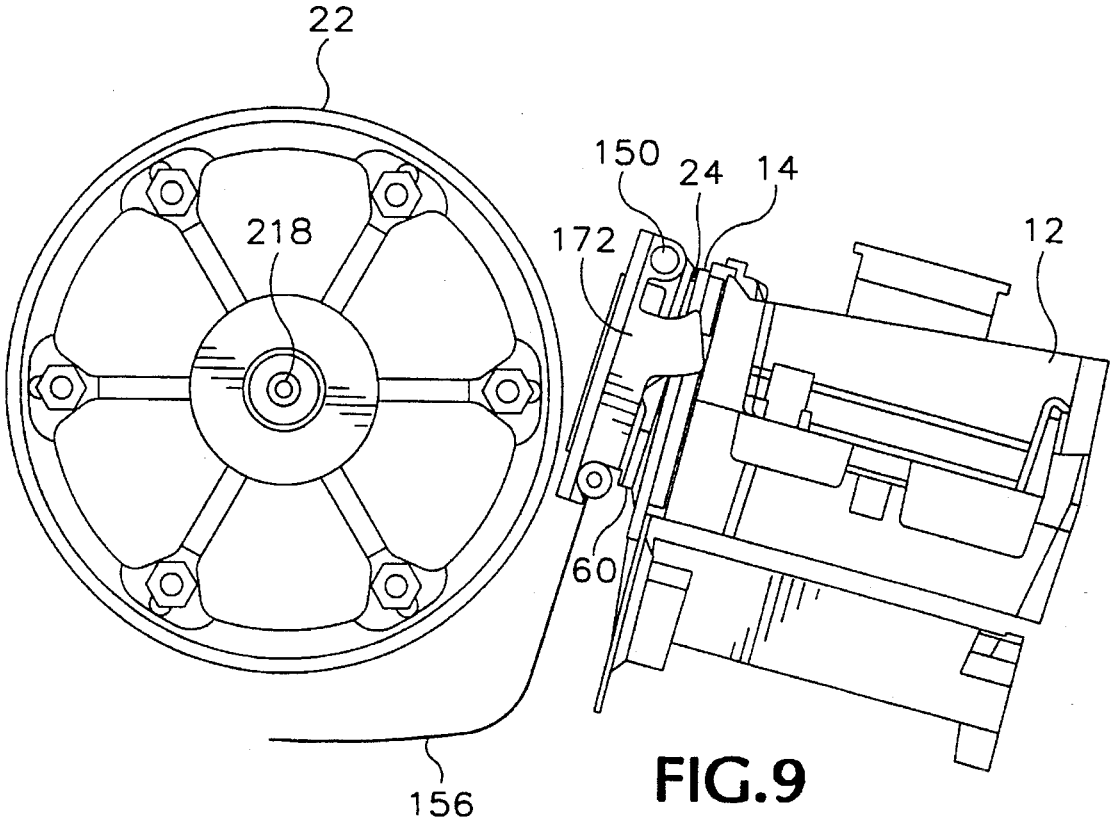
FIG. 9 is an end elevational view of the purge cap, print head, and drum, showing the purge cap and the print head in vacuum seal engagement.

Belt and pulley system 142 includes power-driven pulleys 146 that move a drive belt 148 that is connected to purge cap 24 by a guide pin 150 in support system 28. Pulley system 142 moves purge cap 24 in directions 152 or 154 along a purge cap path 156 so that purge cap 24 is positioned adjacent print head 12 (FIGS. 1, 9, and 11) or is positioned stowed beneath drum 22 (FIG. 10).

Figure 3:
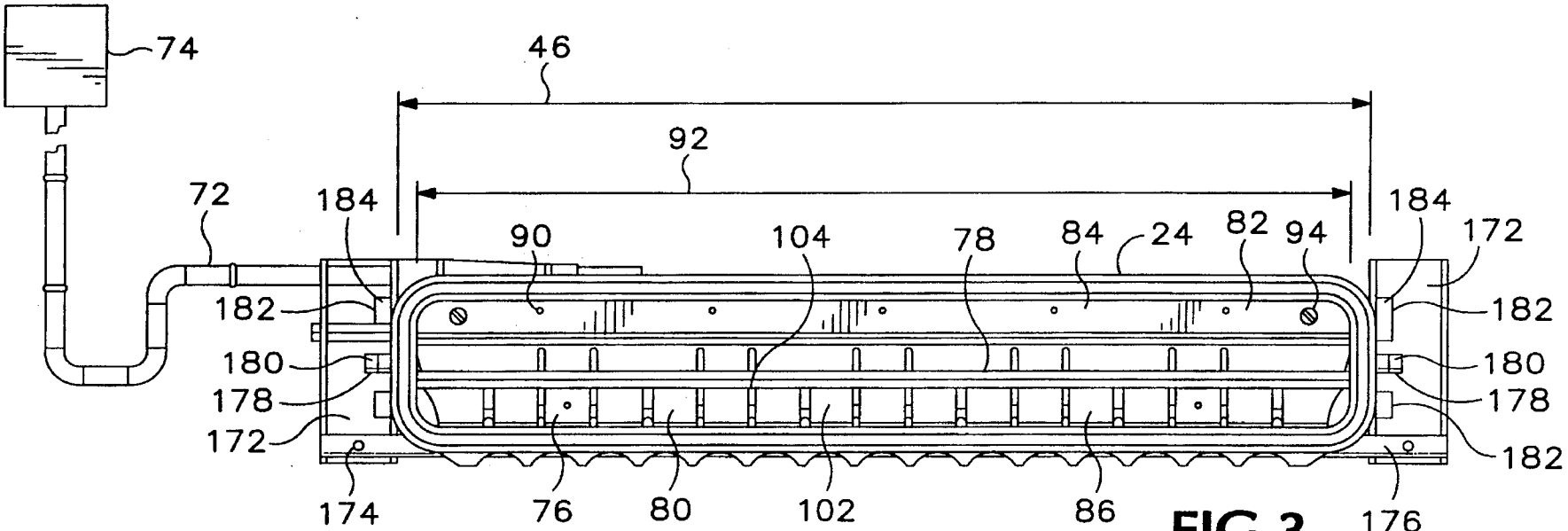
FIG. 3 is a frontal elevation view of the purge cap and wiper assembly.
Figure 4:
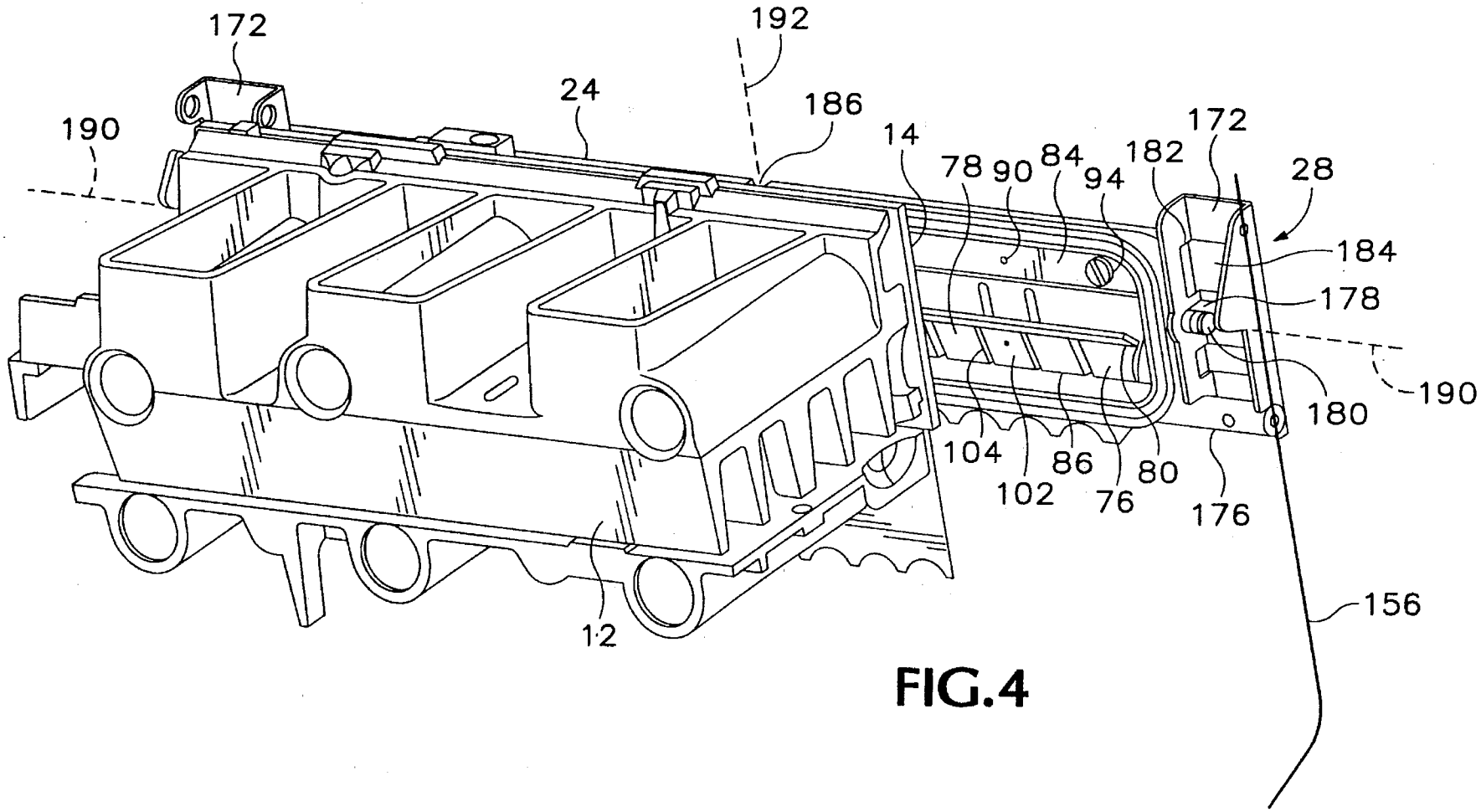
FIG. 4 is an isometric view of the front of the purge cap and the rear of the print head.
Figure 5:
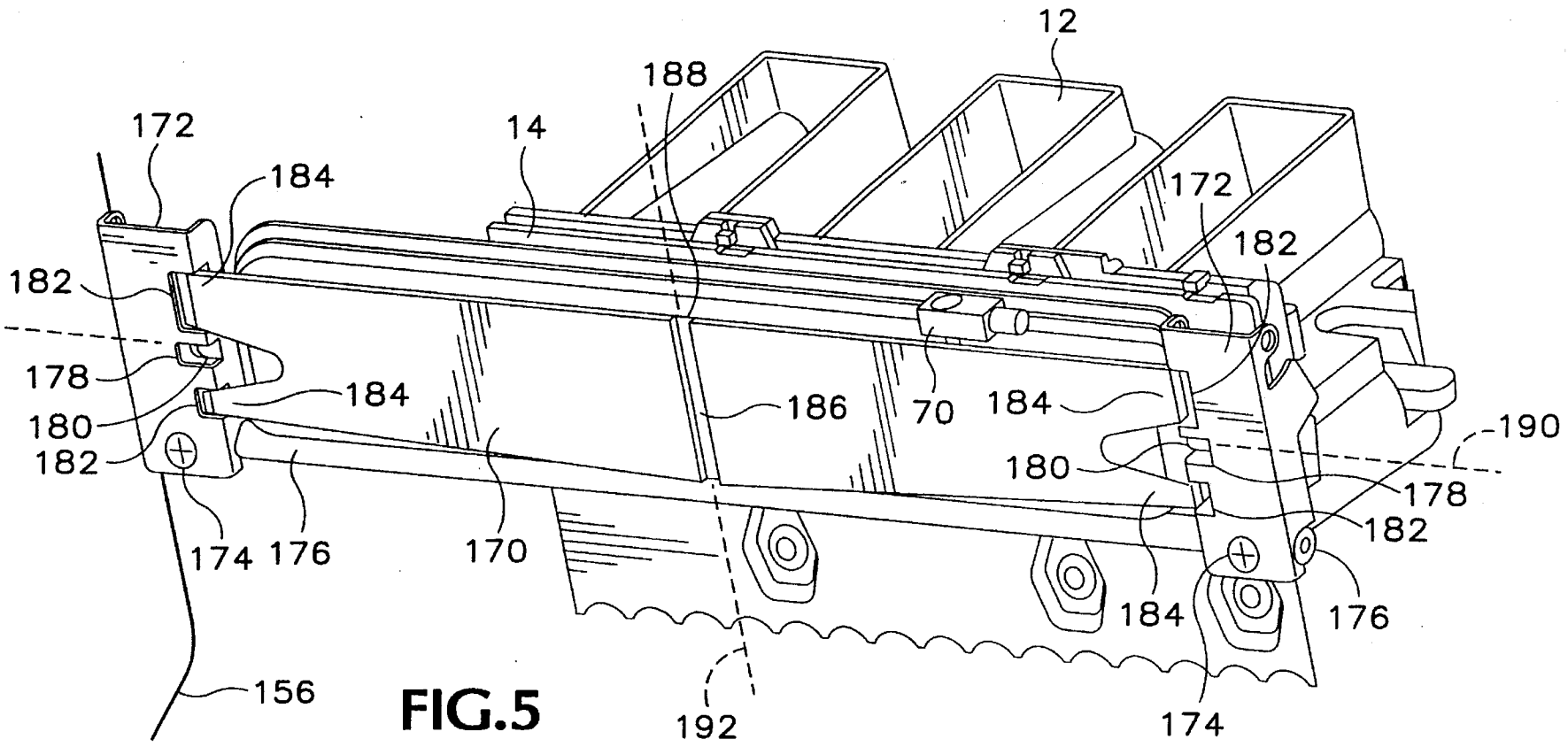
FIG. 5 is an isometric view of the rear of the purge cap and the front of the print head.

FIGS. 3, 4, and 5 show purge cap 24 mounted in support system 28 that includes a cap spring 170 supported at either of its ends by carrier blocks 172 and connected by screws 174 to a tie bar 176. Carrier blocks 172 have recesses 178 for receiving pivot pins 180 of purge cap 24 and openings 182 for securely receiving tab ends 184 of cap spring 170. When cap spring 170 is installed in purge cap 24, groove 186 fits into a pair of notches 188 (FIG. 8) positioned at the midpoint of the length of the exterior of rear wall 34 of purge cap 24. Cap spring 170 is a nominally flat metal plate divided into two sections of equal size by a groove 186 and functions as a leaf spring when tab ends 184 are set in openings 182 of carrier blocks 172 and groove 186 rests in notches 188 of rear wall 34. Carrier blocks 172 are attached to positioning system 30 by guide pin 150 (FIG. 1) so that purge cap 24 and support system 28 are moveable relative to print head 12 along purge cap path 156. Cap spring 170, pivot pins 180, and carder blocks 172 function collectively as a biasing mechanism and are typically manufactured of stainless steel.

Cap spring 170 exerts a bias force on rear wall 34 of purge cap 24 and thereby urges pivot pins 180 of purge cap 24 into recesses 178 and against carder blocks 172. This support arrangement allows purge cap 24 to rotate relative to carrier blocks 172 about an axis 190 through pivot pins 180, to rotate about an axis 192 through notches 188 in rear wall 34 of purge cap 24, or to move in combinations of the two. The biasing mechanism provides, therefore, a substantially uniform sealing engagement between seal 60 and orifice plate 14.

Figure 12:
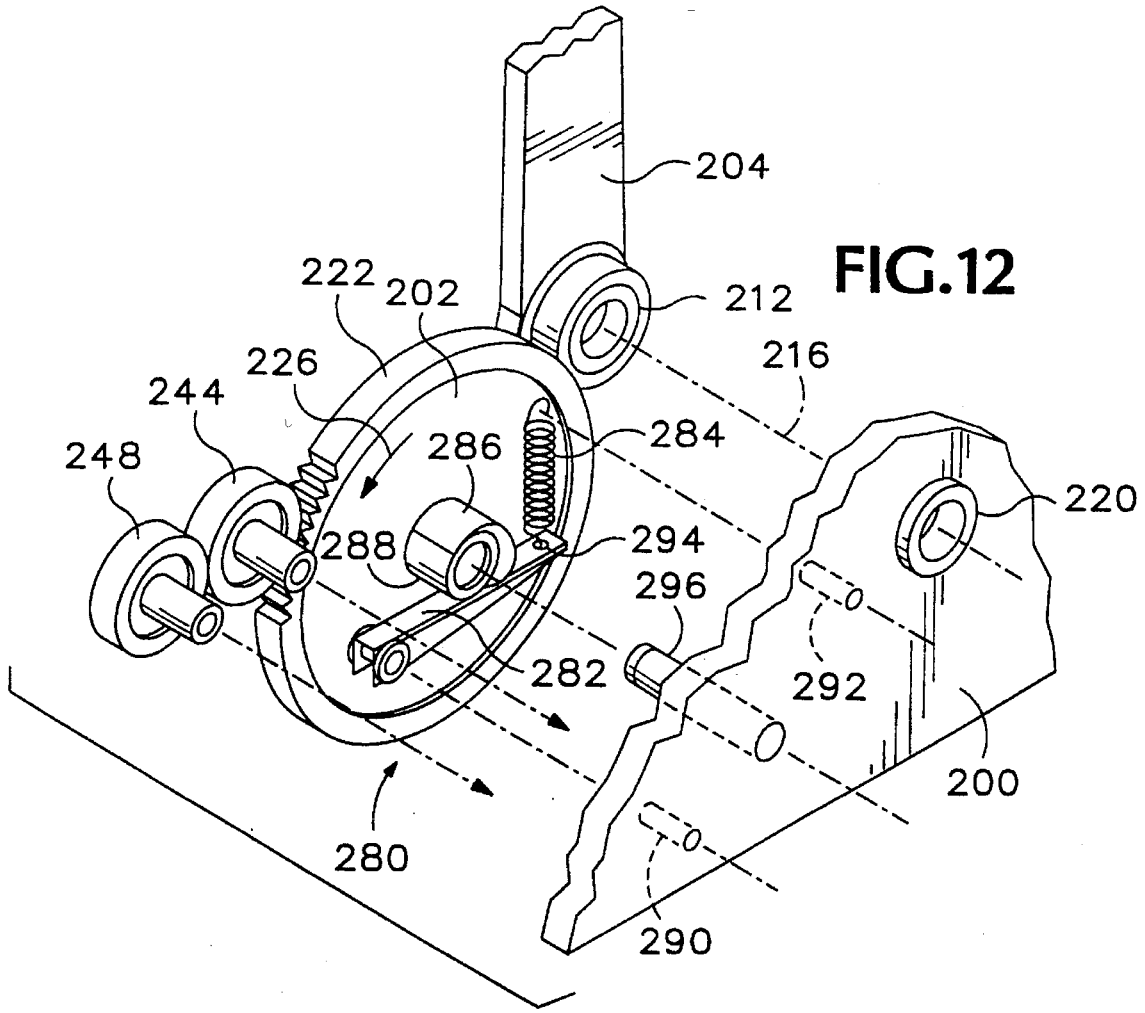
FIG. 12 is an exploded, partly cut away isometric right side view of the tilt angle positioner of FIGS. 1 and 10.

FIGS. 1 and 10 show a preferred embodiment of print head tilt angle system 144 orienting print head 12 in, respectively, the maintenance and the printing position with print head 12 adjacent purge cap 24 in FIG. 1 and in FIG. 10 adjacent drum 22. With reference to FIGS. 1, 10, and 12, the major components of print head tilt angle system 144 are mounted on a left-side frame 200 (FIG. 12) of the printer and include a gear-driven cam 202, a tilt arm 204, a flexure arm 206, a tilt angle adjuster 208, and a biasing spring 210. Tilt arm 204 is attached by a taper lock joint 212 to a left shaft 214 so that tilt arm 204 and print head 12 rotate together about a tilt axis of rotation 216 between printing and maintenance tilt angle positions. Tilt axis of rotation 216 is parallel to a drum axis of rotation 218. Left shaft 214 rotates and slides laterally in left shaft bearing 220 (FIG. 12), which is mounted in left-side frame 200. A right shaft (not shown) rotates and slides in a similar shaft bearing mounted in a right-side frame (not shown).

Gear-driven cam 202 includes a missing-tooth gear 222 (only the missing tooth portion of the gear is shown) and a scroll cam 224. Gear-driven cam 202 is biased to rotate in a direction 226, the biasing mechanism for which is described more fully below with reference to FIG. 12. Missing-tooth gear 222 is held in the printing (disengaged cap) position shown in FIG. 10 by a trigger arm 228 abutting a stop 230 on the periphery of scroll cam 224.

Gear-driven cam 202 is actuated by energizing a solenoid 240 that pivots a trigger arm 242 away from stop 230, thereby causing missing-tooth gear 222 to rotate into engagement with a drive gear 244, which receives rotational power from a drive motor 246 and an idler gear 248. Drive motor 246 subsequently controls the rotation of gear-driven cam 202.

Attached to one end of tilt arm 204 is a follower 250 that rides inside scroll cam 224. Follower 250 is captive within scroll cam 224 over the entire 10-millimeter range of lateral motion of left shaft 214. When gear-driven cam 202 rotates, scroll cam 224 guides follower 250 to provide controlled rotational motion of tilt arm 204 about tilt axis of rotation 216.

The print head tilt angle is controlled by scroll cam 224 in all positions except in the printing tilt angle position. At the printing tilt angle position, a printing distance 252 (FIG. 10) is established by controllably limiting the rotation of tilt arm 204 with flexure 206. In particular, printing distance 252 is determined by adjusting a distance 254 between tilt angle adjuster 208 and a post 256 attached to tilt arm 204 at the end opposite follower 250. Post 256 slides in a slot 258 in flexure 206 for all positions except the printing tilt angle position, at which position post 256 abuts the end of slot 258, thereby limiting the rotation of tilt arm 204. Flexure 206 is attached to tilt angle adjuster 208 by a pivot 260 that is positioned off-center from the rotational axis of tilt angle adjuster 208. Distance 254, and therefore printing distance 252 (FIG. 10), is adjusted by loosening a pair of set screws 270, rotating tilt angle adjuster 208 to the desired position, and then tightening set screws 270. Pivot 260 is preferably off-centered by an amount such that each 10-degree rotational increment of tilt angle adjuster 208 changes printing distance 252 by about 0.0025 millimeter (0.001 inch).

Flexure 206 preferably has a length of about 15.24 centimeters (6 inches) and is manufactured from about 0.05 centimeter (0.02 inch) thick stainless steel 301 available commercially from R.S.P. Manufacturing of Fremont, Calif.

In the printing position, a relief 272 in scroll cam 224 (FIG. 1) disengages follower 250 from scroll cam 224 such that the printing position of tilt arm 204 is determined solely by distance 254. Thus, in the printing position, the angle of tilt arm 204 is determined by flexure 206. Follower 250 is preferably acentric and pivotally attached to tilt arm 204 such that in the adjusted printing position, follower 250 may be adjustably centered adjacent to relief 272 in scroll cam 224.

Flexure 206 is held in tension by biasing spring 210, which removes slack from the system and urges print head 12 toward drum 22 with a preferred force of about 3 pounds in the printing position. During printing, left shaft 214 moves laterally such that flexure 206 bends back and forth as print head 12 traverses drum 22. Flexure 206 maintains printing distance 252 during printing with substantial parallism to drum axis of rotation 218 while enabling substantially frictionless lateral motion of print head 12.

As described above, taper lock 212 connects tilt arm 204 to left shaft 214. The connection is infinitely adjustable to provide a secure joint for coarse head angle adjustment during assembly of tilt angle system 144. Fine adjustment of print head 12 tilt angle is accomplished as described above by tilt angle adjuster 208.

FIG. 12 shows the right side of gear-driven cam 202, drive gear 244, idler gear 248, and a portion of tilt arm 204 exploded apart from a fragment of left side frame 200 to reveal a rotational biasing assembly 280. Gear-driven cam 202 is shown in the printing position at which drive gear 244 is disengaged from missing-tooth gear 222. Rotational bias in direction 226 is developed by urging a lever 282 with a spring 284 to ride against a cam 286 that is positioned on a hub 288 of gear-driven cam 202. Lever 282 and spring 284 are attached to left side frame 200, not gear-driven cam 202 as it appears in FIG. 12. Cam 286 is positioned on hub 288 such that lever 282 and cam 286 apply rotational bias in direction 226 to gear-driven cam 202 when it is in the printing position. Rotational bias is necessary only to engage drive gear 244 with missing-tooth gear 222 when trigger arm 228 is disengaged from stop 230 (FIG. 1).

When assembled, lever 282 is rotationally secured to left-side frame 200 by a post 290 (shown in dashed lines) and captured between washers and a D-ring clip (not shown). Spring 284 is suspended between a post 292 (shown in dashed lines) attached to left side frame 200 and a hole 294 in the free end of lever 282. Gear-driven cam 202 is rotationally secured to left side frame 200 by a post 296 (partly shown in dashed lines) and captured between washers and a D-ring clip (not shown). Shaft 214 (not shown) protrudes through shaft bearing 220 in left-side frame 200 to mate with taper lock 212 on tilt arm 204. Gears 244 and 248 are rotationally secured to left-side frame 200 in a manner similar to that of lever 282 and gear-driven cam 202.

FIGS. 1, 9, 10, and 11 are diagrams that are useful in describing the method of cleaning contamination from orifices 20 and orifice plate 14 of print head 12. During normal use the printer is in the printing position (FIG. 10), with print head 12 positioned adjacent and purge cap 24 stowed below drum 22. Ink is ejected from orifices 20 in orifice plate 14 onto drum 22, which transfers the image formed on its surface to a print medium such as paper.

During the printing process, contamination such as paper dust and unused ink accumulates on the orifice plate 14 and in orifices 20. Between printing sessions the ink may solidify in orifices 20 and, if left unremoved, may hinder future image quality by altering the trajectory of ink ejected from them.

To clean orifices 20 and orifice plate 14, tilt angle system 144 moves print head 12 from the printing position (FIG. 10) to the standby position (FIG. 1), and belt and pulley system 142 moves purge cap 24 along path 156 so that wiper blade 78 is positioned adjacent first region 16 and above orifices 20 of orifice plate 14. The computer control system (not shown) of the printer then turns on heater 128 and vacuum system 74. Tilt angle system 144 next moves print head 12 to the wipe position (FIG. 11) so that orifice plate 14 contacts wiper blade 78 in its nominal position extending outwardly from recessed region 40. Belt and pulley system 142 moves purge cap 24 downwardly in direction 154 so that wiper blade 78 wipes orifice plate 14, and thereby wipes the contamination from first region 16 to second region 18.

Tilt angle system 144 next moves print head 12 to the standby position (FIG. 1), and belt and pulley system 142 moves purge cap 24 to a position adjacent first region 16 of orifice plate 14. Tilt angle system 144 then moves print head 12 to the vacuum seal engagement position (FIG. 9) so that orifice plate 14 contacts seal 60, which is positioned around periphery 44 of purge cap 24. In this position, seal 60 engages and encloses first region 16 of orifice plate 14 containing orifices 20. As tilt angle system 144 forces print head 12 against purge cap 24, orifice plate 14 urges wiper blade 78 rearwardly into recessed region 40 so that wiper blade 78 and seal 60 contact orifice plate 14.

Heater 128, which has reached its heating temperature, heats purge cap 24 and the air within recessed region 40, and thereby heats and melts ink solidified in orifices 20. Vacuum system 74 then creates across orifices 20 a differential pressure that draws the molten ink from orifices 20 onto orifice plate 14 or into recessed region 40. Tilt angle system 144 moves print head 12 to the standby position (FIG. 1), and belt and pulley system 142 moves purge cap 24 upwardly along purge cap path 156 so that wiper blade 178 is positioned above orifices 20. Tilt angle system 144 next moves print head 12 to the wipe position (FIG. 11) so that orifice plate 14 engages wiper blade 78. Belt and pulley system 142 moves purge cap 24 downwardly along path 156 so that wiper blade 78 wipes orifice plate 14 in a direction that is normal to the length of purge cap 24 so that wiper blade 78 wipes the contamination to second region 18 of orifice plate 14. The contamination on second region 18 is forced by gravity to drip into an ink reservoir (not shown) positioned below orifice plate 14.

After wiping the ink to second region 18 of orifice plate 14, a portion of the contamination typically remains on wiper blade 78. To clean wiper blade 78, tilt angle system 144 moves print head 12 to the standby position (FIG. 1) and belt and pulley system 142 moves wiper blade 78 to a position adjacent orifices 20 in first region 16 (FIG. 1). Tilt angle system 144 moves print head 12 slightly toward purge cap 24, and print head 12 is activated to eject clean ink from orifices 20 onto wiper blade 78 to wash the contamination from it. In this position, wiper blade 78 is placed between orifices 20 and purge cap 24 so that ink ejected beyond wiper blade 78 is trapped in recessed region 40 of purge cap 24 and, therefore, does not contaminate the printer. The ink trapped by recessed region 40 is forced by gravity to drip off serrations 66 of seal 60 into the ink reservoir.

Figure 11:
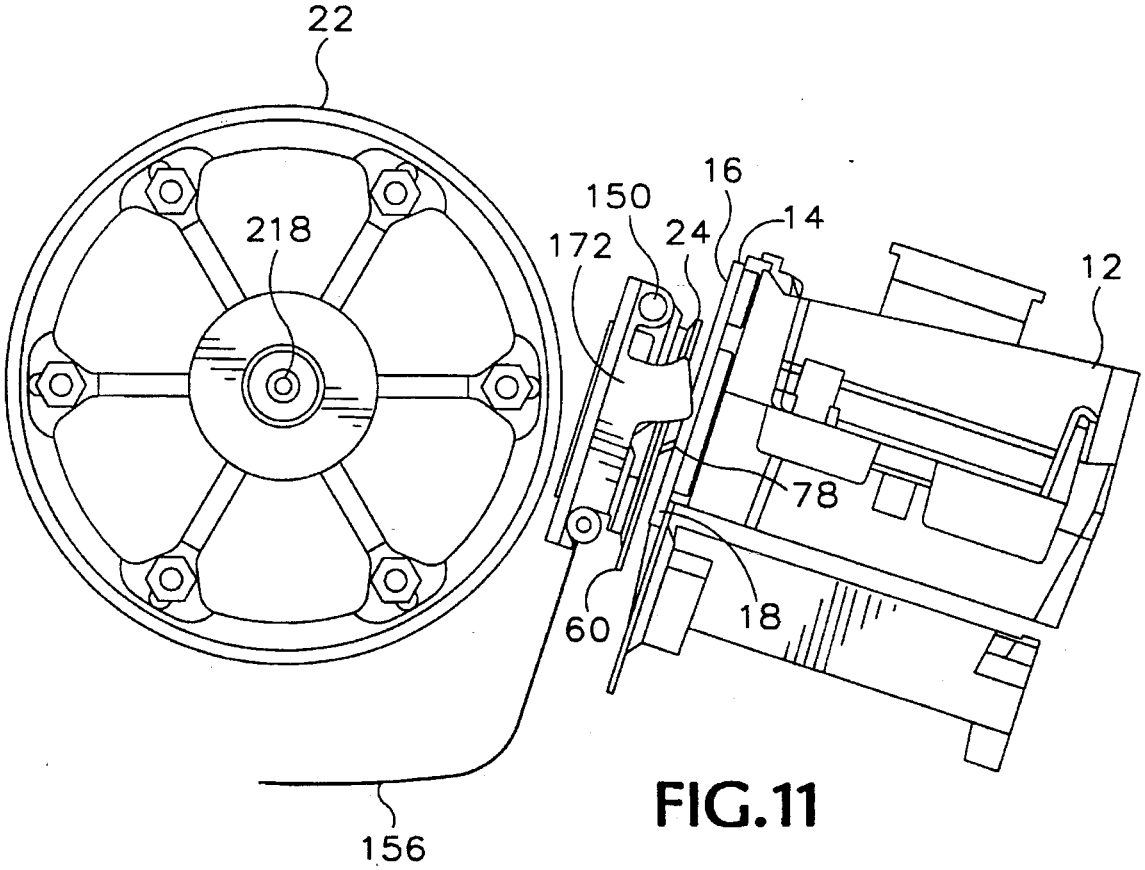
FIG. 11 is an end elevational view of the purge cap, print head, and drum, showing the purge cap and the print head in a disengaged wipe position.

Excess ink remains on wiper blade 78 after it has been washed with clean ink ejected from orifices 20. To remove the excess ink, belt and pulley System 142 positions wiper blade 78 adjacent second region 18 of orifice plate 14 (FIG. 11). Tilt angle system 144 then repeatedly moves print head 12 away from and toward purge cap 24 to alternately disengage wiper blade 78 from and urge it against orifice plate 14. This process is sometimes called "dabbing" the wiper blade. Typically, second region 18 of purge cap 14 is dabbed against wiper blade 78 five times to transfer excess ink from wiper blade 78 to second region 18. During the time between each dab, belt and pulley system 142 moves purge cap 24 and wiper blade 78 upwardly a small incremental distance along cap path 156 so that wiper blade 78 contacts a clean portion of second region 18 during each dab and so that gravity forces the ink on second region 18 downwardly and away from the position of the next dab.

To complete the cleaning operation, orifice plate 14 is wiped in the manner previously described by freshly cleaned wiper blade 78. After the final wipe, wiper blade 78 is washed a second time in the manner previously described. Belt and pulley system 142 then moves purge cap 24 downwardly along purge cap path 156 to the stowed position (FIG. 10) below drum 22 and tilt angle system 144 moves print head 12 to the printing position (FIG. 10) adjacent drum 22.

It will be obvious to those having skill in the art that many changes may be made to the details of the above-described embodiments and method of this invention without departing from the underlying principles thereof. For example, it is possible to retract the print head 12 away from the drum 22 after the image is placed on the liquid intermediate transfer layer, but before transfer of the image to the receiving substrate. Similarly, it is possible with the utilization of a different wiping assembly 26 to have the purge cap 14 remain under vacuum against the orifice plate 14 while the print head 12 is wiped. The scope of the present invention should, therefore, be determined only by the following claims.

We claim:

1. An ink jet print head maintenance apparatus for cleaning an ink jet print head that includes an orifice plate having a region with a row of orifices through which ink is ejected, the orifices being aligned in a row direction, comprising:

a purge cap having a recessed region with an open end, the recessed region defined by a rear wall bordered by side walls having top side margins that define a periphery of the open end, the purge cap having a length that spans the region with the orifices;

a seal positioned around the periphery of the purge cap;

a resilient wiper assembly positioned in the recessed region of the purge cap, the resilient wiper assembly including a wiper blade that extends substantially along the length of the purge cap and nominally outwardly of the recessed region; and a positioning system that applies a force to urge the purge cap and orifice plate against each other and moves the purge cap and the orifice plate relative to each other so that the wiper blade engages and wipes the orifice plate in the region with the orifices, the wiper blade maintaining continuous engagement against the orifice plate while wiping it in a direction transverse to the row direction.

2. The apparatus of claim 1, further comprising a support structure mounting the purge cap to the positioning system, the support structure including biasing means for aligning the purge cap against the orifice plate to provide a substantially uniform engagement between the seal and the orifice plate.

3. The apparatus of claim 1 in which the resilient wiper assembly includes a wiper spring having first and second ends, the wiper spring carrying the wiper blade at the first end and secured to a stiffener proximately at the second end, the wiper spring folded back upon itself at a point medially of the first and second ends and the stiffener supporting the wiper spring at the point.

4. The apparatus of claim 3 in which the wiper spring exerts a spring force and in which the force applied by the positioning system to urge the purge cap and the orifice plate against each other is greater than the spring force of the wiper spring so that the positioning system urges the purge cap and the orifice plate against each other and at the same time urges the wiper blade to retract into the recessed region of the purge cap.

5. The apparatus of claim 1 in which the resilient wiper assembly includes a wiper spring having an end that carries the wiper blade, the wiper spring including multiple spring elements that collectively provide along the length of the wiper blade a substantially uniform engagement pressure between the wiper blade and the orifice plate.

6. The apparatus of claim 5 in which the wiper blade wipes the orifice plate in a direction normal to the row direction and in which adjacent spring elements are spaced apart along the length of the purge cap by distances sufficient to form slots that allow ink to flow through the slots in the wiper spring.

7. The apparatus of claim 1 in which the rear wall of the purge cap has an exterior side, the apparatus further comprising:

a heater thermally coupled to the exterior side of the rear wall, the heater heating the purge cap; and a vacuum system communicating with the recessed region of the purge cap, the vacuum system creating a pressure differential across the orifices when the purge cap is urged against the orifice plate.

8. A method of cleaning an ink jet print head including an orifice plate having a first region with a row of orifices through which ink is ejected, the orifices being aligned in a row direction, comprising the steps of:

positioning a purge cap adjacent the first region of the orifice plate, the purge cap having a closed end and an open end that define a recessed region therebetween, the purge cap having a length that spans the first region and a seal positioned around the open end, and the purge cap having positioned in the recessed region a resilient wiper assembly including a wiper blade that extends substantially along the length of the purge cap and nominally outwardly of the recessed region;

urging the seal of the purge cap and the orifice plate against each other so that the seal engages the orifice plate around the first region of the orifice plate;

creating a pressure differential across the orifices that causes liquified ink present in the orifices to deposit onto the first region of the orifice plate; and moving the wiper blade and the orifice plate relative to each other in a direction transverse to the row direction so that the wiper blade engages and wipes ink from the first region of the orifice plate, the wiper blade maintaining continuous engagement against the orifice plate while wiping ink from the first region.

9. The method of claim 8 further comprising using a source of heat to liquify the ink before creating the pressure differential across the orifices.

10. The method of claim 8, further comprising:

disengaging the wiper blade from the orifice plate;

positioning the wiper blade adjacent the orifices; and ejecting ink from the orifices onto the wiper blade to wash it.

11. The method of claim 8 in which the orifice plate includes a second region adjacent the first region, the method further comprising:

disengaging the wiper blade from the orifice plate;

positioning the wiper blade adjacent the second region of the orifice plate; and repeatably engaging and disengaging the wiper blade and the second region of the orifice plate to transfer ink from the wiper blade to the second region.

12. The method of claim 8 in which the orifice plate includes a second region adjacent the first region, the method further comprising:

disengaging the seal of the purge cap and the orifice plate;

engaging the wiper blade and the first region of the orifice plate; and moving the wiper blade and the orifice plate relative to each other so that the wiper blade wipes ink from the first region to the second region.

13. The method of claim 8 further comprising maintaining the differential pressure across the orifices while the wiper blade engages the orifice plate.

* * * * *

UNITED STATES PATENT AND TRADEMARK OFFICE

CERTIFICATE OF CORRECTION

PATENT NO. : 5,570,117
DATED : October 29, 1996
INVENTOR(S) : Randy C. Karambelas, Ernest I. Esplin, Terry A. Smith, Mike C. Gordon, Stephen H. Skidmore It is certified that error appears in the above-indentified patent and that said Letters Patent is hereby corrected as shown below:

Column 5, line 32, "fiat" should be "flat" ;

Column 5, line 40, "carder" should be "carrier" ;

Column 5, line 45, "carder" should be "carrier" .

Signed and Sealed this

Twenty-first Day of January, 1997

*Attest:*

Bruce Lehman

BRUCE LEHMAN

*Attesting Officer*

*Commissioner of Patents and Trademarks*